US009643227B2

(12) United States Patent
Del Fabro

(10) Patent No.: US 9,643,227 B2
(45) Date of Patent: May 9, 2017

(54) DRAWING UNIT AND CORRESPONDING METHOD

(71) Applicant: Giorgio Del Fabro, Udine (IT)

(72) Inventor: Giorgio Del Fabro, Udine (IT)

(73) Assignee: M.E.P. MACCHINE ELETTONRICHE PIEGATRICI SPA, Reana del Rojale, (UD) (IT)

( * ) Notice: Subject to any disclaimer, the term of this patent is extended or adjusted under 35 U.S.C. 154(b) by 0 days.

(21) Appl. No.: 14/725,675

(22) Filed: May 29, 2015

(65) Prior Publication Data

US 2015/0343508 A1 Dec. 3, 2015

(30) Foreign Application Priority Data

May 29, 2014 (IT) ..... UD2014A0090

(51) Int. Cl.
*B21D 3/02* (2006.01)
*B21D 43/00* (2006.01)
(Continued)

(52) U.S. Cl.
CPC ..... *B21D 3/02* (2013.01); *B21D 3/05* (2013.01); *B21D 43/006* (2013.01);
(Continued)

(58) Field of Classification Search
CPC ..... B21D 3/02; B21D 3/05; B21D 43/006; B21F 1/04; B21F 23/002; B21F 23/005; B21C 3/08
See application file for complete search history.

(56) References Cited

U.S. PATENT DOCUMENTS 4,829,801 A * 5/1989 McRaine ..... B21F 1/02 72/164
5,676,010 A * 10/1997 College ..... B21F 1/02 72/162
(Continued)

FOREIGN PATENT DOCUMENTS

EP 2399856 12/2011
JP 53140268 12/1978
(Continued)

OTHER PUBLICATIONS

Italian Search Report and Written Opinion, issued in the corresponding Italian application No. UD2014A000090, mailed Jan. 15, 2015, 7 pages.
Japanese Office Action issued in the corresponding Japanese patent application No. 2015-031534, dated Mar. 1, 2016, 16 pages.

*Primary Examiner* — Teresa M Ekiert
(74) *Attorney, Agent, or Firm* — Hamre, Schumann, Mueller & Larson, P.C.

(57) ABSTRACT

Drawing unit for drawing at least one long metal product (P), configured to make the at least one long metal product (P) advance along a nominal axis of feed (A) and provided with at least a first motorized roll (13) and with at least two second rolls (14) operating at the periphery of the first roll (13) and defining, with the latter, respective passage gaps (15). The at least two second rolls (14) are located one on one side and the other on the other side of the axis (N) orthogonal to the nominal axis of feed (A) that passes through the center of rotation of the first roll (13). The second rolls (14) are associated to movement members (21) to move the second rolls (14) in a parallel form with respect to each other and in a direction substantially orthogonal to said nominal axis of feed (A) in order to adjust the passage gaps (15). The passage gaps (15) have, during use, along the straight line (R) that joins the center of the first roll (13) with
(Continued)

the center of the respective second roll (14), an amplitude (G) that is bigger in size than the nominal diameter (D) of the metal product (P).

10 Claims, 4 Drawing Sheets

(51) Int. Cl.
*B21D 3/05* (2006.01)
*B21F 23/00* (2006.01)
*B21F 1/04* (2006.01)

(52) U.S. Cl.
CPC ..... *B21F 23/002* (2013.01); *B21F 1/04* (2013.01); *B21F 23/005* (2013.01)

(56) References Cited

U.S. PATENT DOCUMENTS

| | | | |
|---|---|---|---|
| 2003/0034809 | A1 | 2/2003 | Nakashima |
| 2015/0128675 | A1 | 5/2015 | Abe et al. |

FOREIGN PATENT DOCUMENTS

| | | |
|---|---|---|
| JP | 62183914 | 8/1987 |
| JP | 62199219 | 9/1987 |
| JP | 7148538 | 6/1995 |
| JP | 2001009523 | 1/2001 |
| JP | 2007229745 | 9/2007 |
| JP | 2013226582 | 11/2013 |
| WO | 2012110136 | 8/2012 |

* cited by examiner

DRAWING UNIT AND CORRESPONDING METHOD

FIELD OF THE INVENTION

The present invention concerns a drawing unit for drawing long metal products such as bars, round pieces or metal products, ribbed or not, advantageously but not exclusively, of the type which can be used to make reinforcements for the building trade.

In particular, the drawing unit is intended to carry out a constantly uniform, coordinated and simultaneous feed to machines, preferably but not only, bending/shaping machines that simultaneously work one, two or more metal products at a time.

BACKGROUND OF THE INVENTION

Bending/shaping machines or also stirrup-making machines are known, hereafter bending machines, in which bending units or devices are fed with long metal products, such as metal products from a roll, or pre-cut bars, in order to make reinforcement stirrups for the building trade. Hereafter these base materials, whether from a roll or already in bars, will be referred to generically as metal products.

By metal products we mean therefore a nominally round product obtained by hot or cold rolling, with a diameter that normally varies from 5 mm to 20 mm and provided, or not, with ribs that are useful in the case of reinforcements for the building trade.

It is also known that upstream of the bending unit, bending machines have a drawing unit to feed the metal product to the operating units of the machine, such as at least a shears and at least a bending unit.

Normally, apart from the drawing unit, a straightening unit is provided and a unit, possibly structured in the straightening unit, suitable to eliminate torsion in the metal product.

Furthermore, when two or more metal products are fed, the drawing unit has a drawing motion to be able to feed the same lengths simultaneously.

It is known, in fact, that the metal product is not always already linearized before it is fed to the bending unit.

It is also known that the metal product has a tendency to rotate around its axis when the internal tensions are released, for any reason whatsoever.

It is also a known problem that during the drawing function, due to the forces in play needed to have a controlled drawing, in order to grip the metal product correctly and draw it, the ribs present on the periphery are often deformed, making the metal product at least partly lose its effect of adhering to a cast of concrete.

It is also a known problem that, when two or more metal products are drawn simultaneously, it is unlikely that the drawing effect will translate the same length in the two or more metal products, due to the differences in size which occur at different points in the metal products drawn.

It is therefore obvious that a bending operation performed on the metal product is conditioned by the deficiencies in said product, so that the geometric shapes eventually made with the metal product not only do not maintain the desired geometric disposition, but moreover they do not even maintain the flat spatial disposition.

In these cases, the stirrups deriving from such bending are low quality and unreliable once installed, and therefore they are normally discarded, or they require longer installation times. To this must be added the fact that, in the case of metal products for reinforcement rods, given the continuous variation in their section, the correct and accurate straightening and/or drawing become uncertain, inconstant and not uniform.

It must be indicated here that metal products for reinforcements have an extensive range of nominal diameters that can go from 5 mm to 20 mm and more, and that a bending machine must always be able to work at least most of this range of measurements and obtain in any case a perfect product.

It is also known that the level of problems posed by a small metal product is different from the problems posed by a metal product with a bigger diameter.

It must also be noted that, in a bending machine, the drawing unit assumes another considerable importance, since it is also responsible for defining the measurements required on each occasion between one bending operation and the next.

This becomes even more important when the drawing unit works two or more metal products simultaneously.

When the drawing unit does not obtain its purpose constantly and without mistakes, it is not possible either to obtain stirrups or other shapes of metal product having the desired sizes and shapes, or to obtain, in sequence or otherwise, a plurality of identical stirrups or other shapes.

One purpose of the present invention is to obtain a drawing unit that does not damage the metal product being worked.

Another purpose of the present invention is to obtain a drawing unit that can operate continuously and precisely with any type of metal product, in particular metal products for reinforcements.

Another purpose of the present invention is that the drawing unit feeds precisely both one metal product and two or more metal products simultaneously.

Another purpose is that the drawing unit also performs the function of straightening.

Another purpose of the invention is that the drawing unit prevents the metal product from rotating on itself.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a drawing unit for drawing at least one metal product comprises a plurality of rolls configured to make the long metal product advance along a nominal axis of feed.

According to one solution, one or more drawing units according to the present invention can be provided, where it is desired to reduce to a minimum even the smallest deficiency.

The drawing unit, in its basic form, is provided with at least a first motorized roll with a certain diameter, and with at least two second rolls operating at the periphery of the first roll and defining, with the latter, respective passage gaps for the metal product.

The second rolls are located substantially astride an axis orthogonal to said nominal axis of feed of the metal product. Moreover, the orthogonal axis passes though the center of rotation of the first roll.

The second rolls can be positioned in a controlled manner along the orthogonal axis.

According to the invention the first roll is motorized.

According to a variant, the second rolls are motorized, or are also motorized.

According to a possible form of embodiment, given the diameter of the first roll as base, the second rolls have a diameter comprised between 0.30 and 0.70 times the diameter of the first roll, preferably between 0.45 and 0.55, the latter value allowing to maximize the straightening results.

According to the invention, the two second rolls, which cooperate directly with the orthogonal axis, are positioned, one with respect to the other at a distance comprised between 1.01 and 1.70 times the diameter of the second rolls, preferably between 1.02 and 1.3 times. This last range of values allows to increase the guiding action exerted by the rolls on the metal product.

According to the invention, the second rolls have the same diameter.

According to a variant the second rolls have a different diameter from each other, which can vary between 1.05 and 1.30.

During the working, the metal product is located between the first roll and the second rolls.

According to the invention, the metal product located between the first roll and the second rolls is not obliged to follow the total curvature of the first roll, as would happen if the two second rolls were thrust to the maximum, that is, under pressure, toward the first roll.

In other words, the drawing effect is obtained by making the metal product assume an arched shape and said arched shape is the one that is useful and sufficient so that the metal product is drawn.

In cooperation with the rolls of the individual drawing unit, the invention provides a support roll on entrance and a support roll on exit with respect to the drawing unit, said additional rolls operating in cooperation with the nominal axis of the metal product.

This makes the metal product assume a sinuous conformation which starts with the support roll on entrance and ends with the support roll on exit.

As a variant, it is provided that the two support rolls locate their position of contact with the metal product just above the nominal axis.

According to a variant, at least two drawing units are provided, located in sequence. This solution is useful to guarantee that any deformation on the metal product is eliminated.

According to one aspect of the present invention, each of the passage gaps has, during use, along the straight line joining the center of the first roll with the center of the respective second roll, a greater amplitude than the diameter of the metal product.

According to possible formulations of the invention, said amplitude can vary, depending on the type of material, between 1.02 and 1.30, preferably between 1.04 and 1.08, the nominal diameter of the metal product. The latter range of values allows to optimize the guiding effect on the metal product between the rolls and prevents the latter exerting a compression action on the metal product.

In this way, the metal product is no longer compressed between the rolls of the drawing unit, with possible surface damage thereto, but the action of the rolls is only to make the metal product follow a roughly sinusoidal, predefined and controlled path.

The path thus generated creates tensioning loops that allow both to straighten the metal product and also to clamp its rotation on itself. This allows to obtain a controlled and desired drawing, even in the case of two or more metal products worked at the same time.

The present invention also concerns a drawing and straightening method for a metal product.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
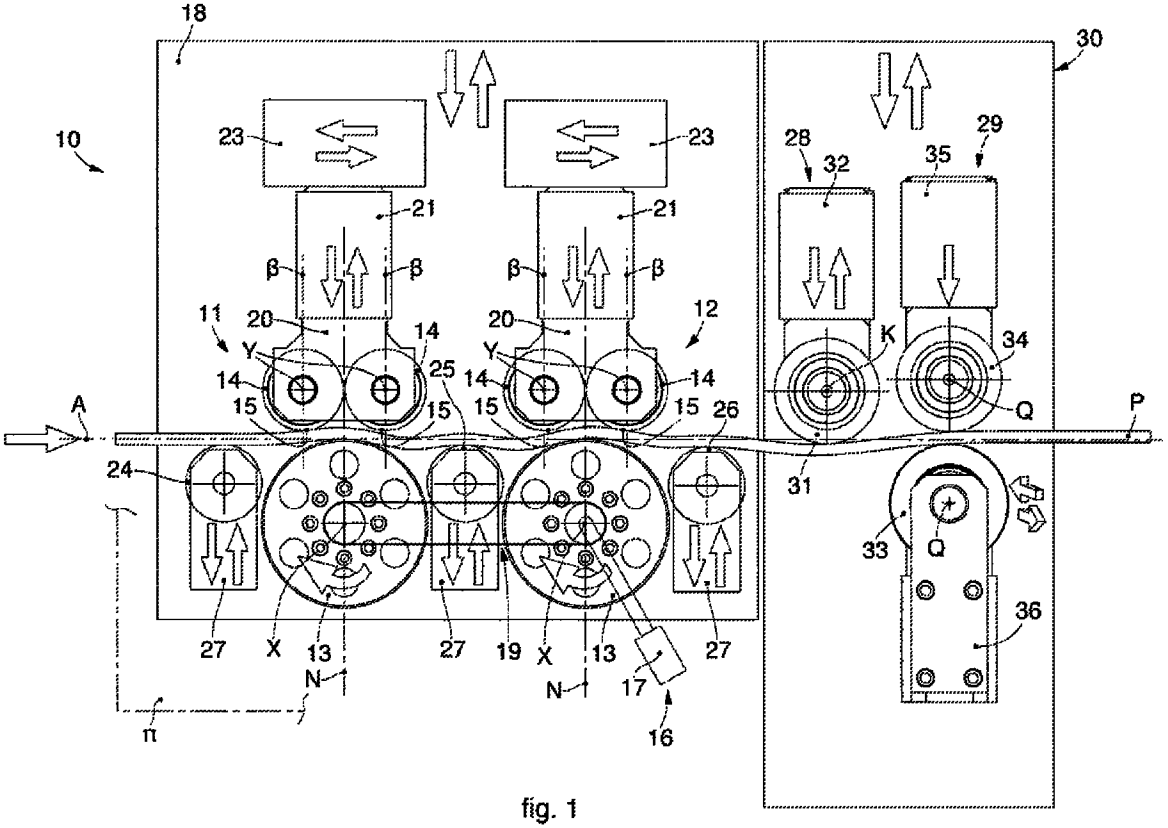
FIG. 1 is a schematic front view of a drawing unit in accordance with a possible form of embodiment of the present invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF FORMS OF EMBODIMENT

A drawing unit according to the present invention is suitable to work one or more long metal products P at a time, even if here and hereafter, for the sake of simplicity, a drawing unit will be described configured to work a single metal product P at a time.

In the forms of embodiment shown in FIGS. 1-4 two drawing units are provided, respectively a first drawing unit 11 and a second drawing unit 12 located downstream of the first drawing unit 11.

The first drawing unit 11 and the second drawing unit 12 together define a drawing apparatus 10.

In particular, the first drawing unit 11 and the second drawing unit 12 can be disposed consecutively with respect to each other along a nominal axis of feed A of the metal product P.

Having two drawing units located in succession to each other reduces the effect of torsion which is induced on the metal product P during its movement.

According to some forms of embodiment, the first drawing unit 11 and the second drawing unit 12 can both be mounted on the same support structure 18.

According to possible forms of embodiment (FIGS. 1 and 2), both the first drawing unit 11 and the second drawing unit 12 each comprise a first roll 13 and two second rolls 14 located peripherally to the first roll 13.

According to a variant, it is also possible to provide three or four rolls 14 to shape the sinuosity of the metal product P particularly in the presence of specific problems, for example, caused by particular materials that make up the metal products. For example, in the form of embodiment in FIGS. 3 and 4, at least one of either the first drawing unit 11 or the second drawing unit 12, in this case the first drawing unit 11, comprises three second rolls 14 operating on the periphery of the first roll 13.

The first roll 13 and the second roll 14 of the first 11 and second drawing unit 12 can both lie on a common lying plane $\pi$.

The lying plane π can substantially correspond to the plane on which the metal product P is located and made to advance.

The first rolls 13 are mounted rotatable around a first axis of rotation X whilst the second rolls 14 are mounted rotatable around a second axis of rotation Y.

The first axes of rotation X and the second axes of rotation Y can be disposed substantially orthogonal to the lying plane π.

According to a possible form of embodiment, the first roll 13 has a bigger diameter than that of the second rolls 14.

According to a possible form of embodiment the first roll 13 can have a diameter comprised between 100 mm and 300 mm and the second rolls 14 can have a diameter comprised between 40 mm and 210 mm.

According to one embodiment of the invention, at least two second rolls 14 are located one on one side and one on the other side with respect to an axis N orthogonal to the nominal axis of feed A and located through the center of rotation of the respective first roll 13.

In this condition, the metal product P is obliged by the second rolls 14 to follow the curvature of the first roll 13.

The first rolls 13 and/or the second rolls 14 can have a contact surface with the metal product P which is processed substantially cylindrical or shaped to define grooves for receiving and containing the metal product P.

The grooves can be U- or V-shaped depending on the particular drawing conditions of the metal product P required, and the contact position with the metal product P also varies depending on the diameter of the latter.

Hereafter in the description, for the sake of simplicity, we will maintain that the first rolls 13 and the second rolls 14 are substantially cylindrical in shape with a cylindrical contact surface with the metal product P, even if a different configuration is not excluded.

According to one solution of the present invention, during use, each of the second rolls 14 defines with the first roll 13 a passage gap 15 through which the metal product P passes.

According to one form of embodiment, the passage gap 15 has an amplitude G, estimated along a straight line R that joins the centers of the first roll 13 and the second roll 14, bigger than the nominal diameter D of the metal product P. The passage gap 15 is estimated in correspondence to the respective contact surfaces of the first roll 13 and the second roll 14.

Moreover, again during use, the first roll 13 and the second roll 14 are in contact with the metal product P which is being worked.

In other words it is provided that the minimum distance between the circumferential contact surfaces with the metal product P of the first roll 13 and of each of the second rolls 14 is bigger in size than the nominal diameter D of the metal product P which is made to transit.

The contact condition of the metal product P with the first roll 13 and with the second roll 14 allows to guarantee a drawing effect on the metal product P which is made to advance, and also allows to define in the metal product P one or more yield loops which provide to straighten the latter, eliminating residual internal tensions which can recur on the final metal product P.

The condition of amplitude G of the passage gap 15 which is greater than the nominal diameter D of the metal product P prevents a compression of the latter between the first roll 13 and the second roll 14 and therefore limits possible surface damage thereto.

Moreover, this last condition means that, during use, the metal product P contacts the first roll 13 in a different zone, translated upstream or downstream, along the nominal axis of feed A, other than that in which it contacts the second rolls 14.

According to a possible solution, each of the second rolls 14, of the first drawing unit 11 and the second drawing unit 12, defines a lying plane β on which the second axis of rotation Y lies and which is disposed substantially orthogonal to the nominal axis of feed A of the metal product P.

According to possible solutions, at least two of the second rolls 14 both of the first drawing unit 11 and also of the second drawing unit 12, are disposed so that they have their respective lying planes β intersecting the bulk of their respective first roll 13.

This condition obliges the second rolls 14 to be positioned in direct proximity to the first roll 13 so that the bending loop which is generated is rather restricted around the first roll 13, and allows to obtain an adequate straightening action.

Figure 2:
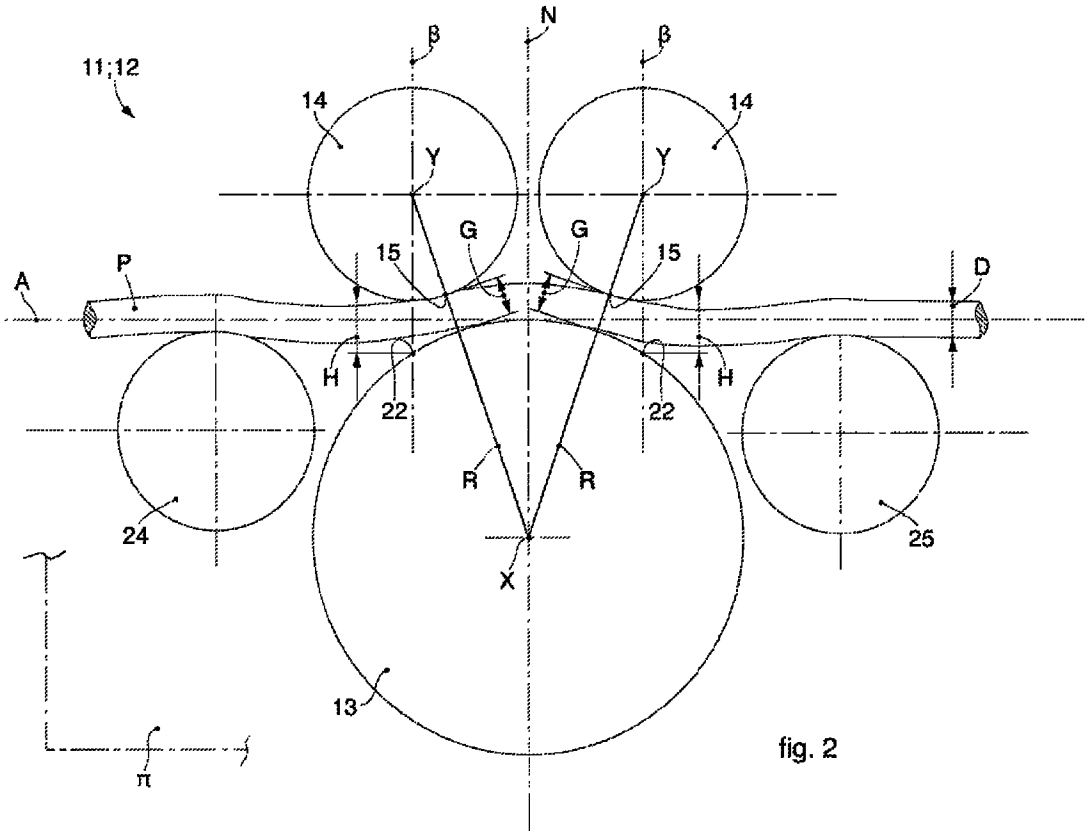
FIG. 2 is a schematic view of an enlarged detail of the drawing unit in FIG. 1.
Figure 4:
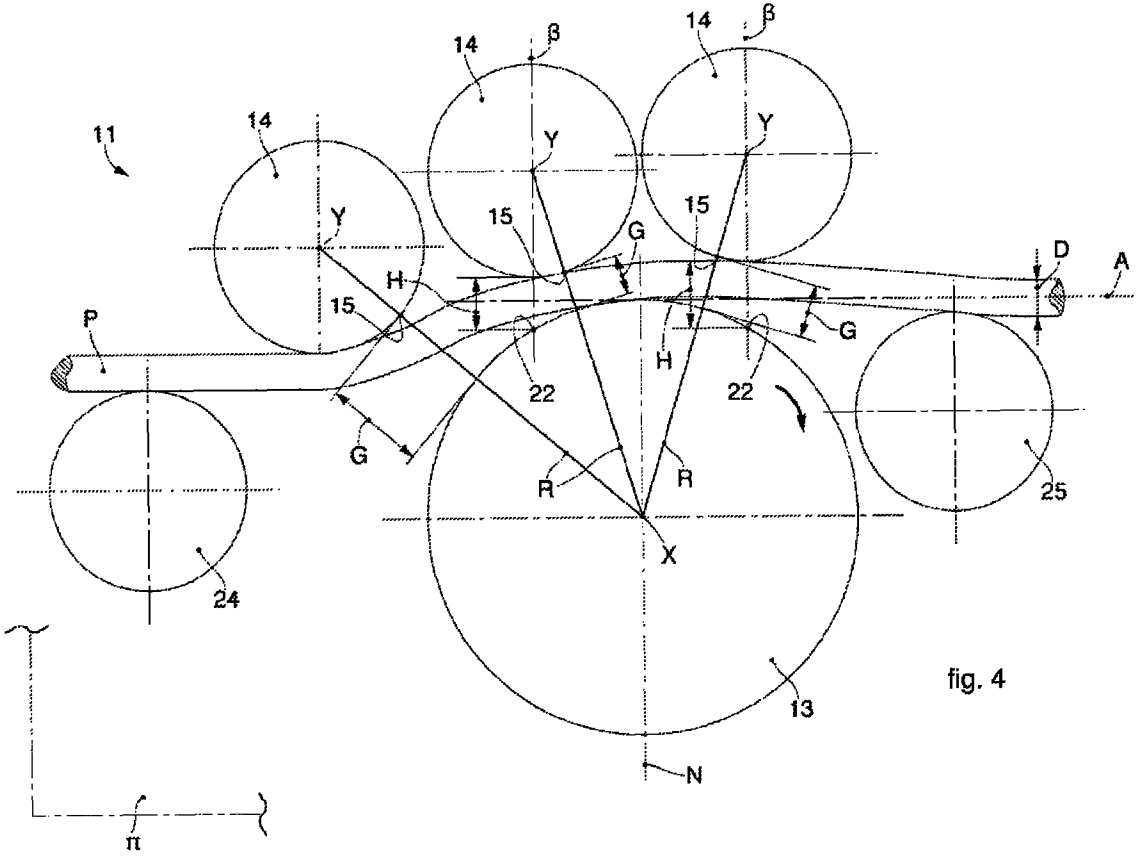
FIG. 4 is a schematic view of an enlarged detail of the drawing unit in FIG. 3.

With reference to FIGS. 2 and 4, for at least the two second rolls 14, on the projection of the lying plane β on the lying plane π, between the first roll 13 and the second roll 14, an interspace 22 is defined with an amplitude H that is bigger in size than the metal product P in transit.

In this way, in correspondence to the interspace 22, the metal product P is located solely in contact with the second roll 14 and not in contact on the first roll 13.

This condition recurs, along the longitudinal axis of development of the metal product P, on each of its cross sections estimated orthogonally to the longitudinal axis of development of the metal product P. Indeed, in each cross section, the metal product P is located in contact either with the first roll 13 or with one of the second rolls 14, not simultaneously with the first roll 13 and with the second roll 14.

The second rolls 14, although they do not compress the metal product P against the first roll 13, oblige the metal product P to at least partly wrap around the external circumferential surface of the first roll 13, generating the tensioning and/or yield loop in the metal product P and guaranteeing a sufficient friction on the first roll 13, with the purpose of making the metal product P advance without slipping.

Figure 3:
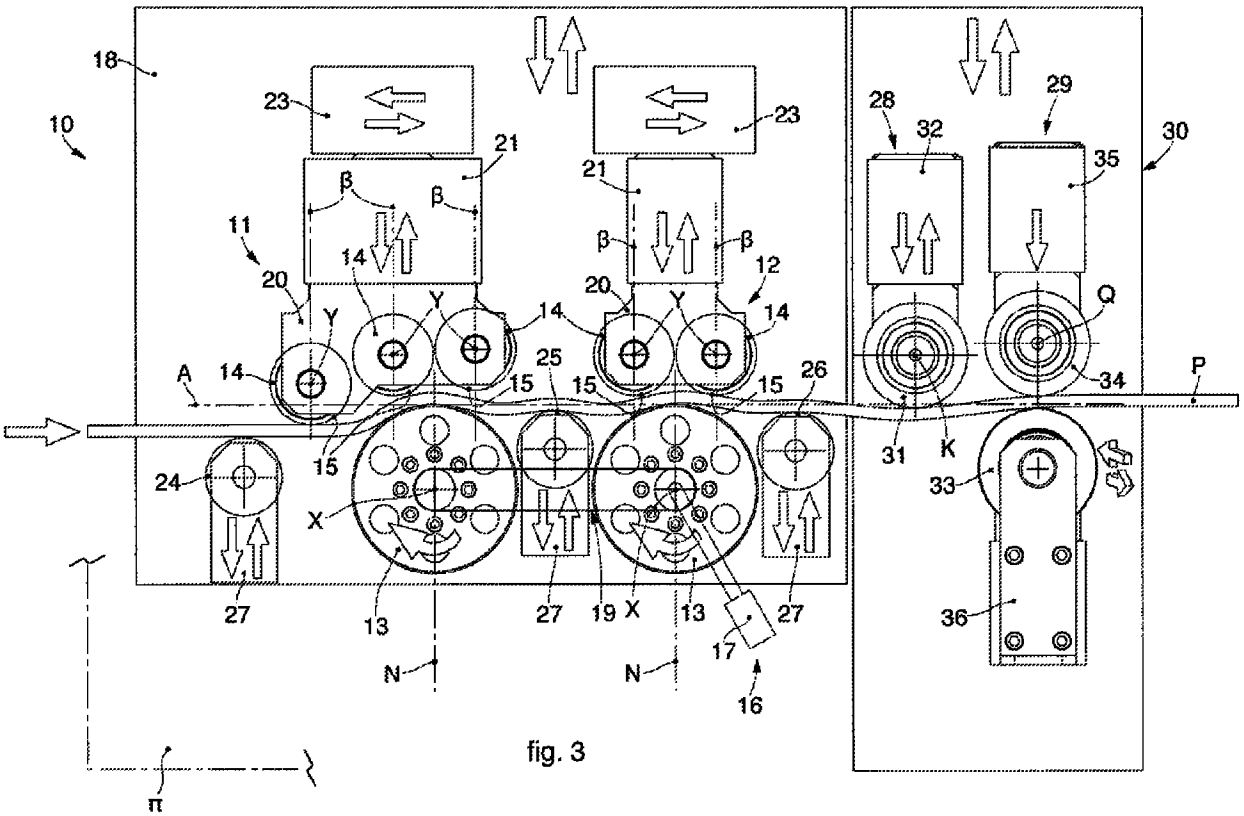
FIG. 3 is a possible variant of FIG. 1.

According to the form of embodiment shown in FIGS. 3 and 4, one of the second rolls 14, in this case the second roll 14 located more upstream with respect to the other second rolls 14, can be positioned outside the bulk defined by the first roll 13, along the nominal axis of feed A.

Moreover, in other solutions, the second roll 14, positioned more upstream, is disposed so that it has its own peripheral surface in contact with the metal product P positioned at a lower height with respect to the peripheral contact surface with the metal product P of the first roll 13.

This solution, which is particularly advantageous for metal products P with a reduced diameter, less than 8 mm for example, has the purpose of generating on the metal product P another tensioning loop that increases the straightening effect on the metal product P.

According to possible forms of embodiment of the present invention, the first roll 13 of the first drawing unit 11 and the first roll 13 of the second drawing unit 12 are connected to a motor member 16 suitable to make them rotate around their first axis of rotation X.

According to the form of embodiment in FIGS. 1 and 3, the motor member 16 can comprise a motor 17 connected to the first roll 13 of the second drawing unit 12 and synchronization devices 19 which connect the first rolls 13 of the first drawing unit 11 and of the second drawing unit 12 to each other, so as to synchronize their speed of rotation.

The motor 17 can be chosen from a group comprising an electric motor, a hydraulic motor, a pneumatic motor.

The synchronization devices 19 can be chosen from a group comprising a belt, a chain, a cable, gears, electronic motor synchronization units, or similar.

According to the form of embodiment in FIG. 1, the second rolls 14 are mounted idle on a support device 20, they are maintained, during use, in a fixed position with respect to the corresponding first roll 13 and are free to rotate around the respective second axes of rotation Y.

In other words, the second rolls 14 are mobile toward the first roll 13 in a parallel form with respect to each other and in a direction orthogonal to the nominal axis of feed A of the metal product P.

A fixed positioning of the second rolls 14 with respect to the corresponding first roll 13 allows to prevent compression conditions of the metal product P between the rolls 13, 14.

According to a possible form of embodiment, the second rolls 14 of the first drawing unit 11 and of the second drawing unit 12 are selectively movable, by respective movement members 21, to move reciprocally nearer and/or away from the respective first roll 13 in order to adjust the size of the passage gaps 15.

In particular, the movement members 21 are configured to move the second rolls 14 in a parallel way with respect to each other and in a direction substantially orthogonal to the nominal axis of feed A.

According to a possible form of embodiment, the movement members 21 are connected to the support device 20 and are configured to move the support device 20 and the second rolls 14 in a block, bringing them reciprocally near to and away from the first roll 13.

The movement members 21 can be chosen from a group comprising an adjustment screw, sliding guides, electric actuators, oil-dynamic actuators, screw jacks, electric motors, mechanical kinematisms, worm-screw kinematisms, racks or possible combinations thereof.

According to possible forms of embodiment, the movement members 21 of the first drawing unit 11 and of the second drawing unit 12 can be commanded simultaneously, or alternatively, independently from each other.

According to another form of embodiment of the present invention, it can be provided that the second rolls 14 of the first drawing unit 11 and/or of the second drawing unit 12, are associated to a positioning member 23 configured to move the second rolls 14 in a direction substantially parallel to the nominal axis of feed A of the metal product P.

This allows to vary the travel to which the metal product P is subjected during use and to control the yield effect induced on the latter.

According to a possible variant, the second rolls 14 of the first 11 and/or second 12 drawing unit are each associated to its own positioning member 23.

It can be provided that the positioning member 23 is configured to modify the interaxis between the pair of second rolls 14 of the first 11 and/or of the second drawing unit 12.

The positioning member 23 can be chosen from a group comprising an adjustment screw, a rack, a worm-screw, an actuator, a jack, sliding guides, or a possible combination thereof.

Upstream and downstream of at least one of either the first drawing unit 11 or the second drawing unit 12, support rolls can be mounted, in this case a first support roll 24, a second support roll 25 and a third support roll 26, selectively movable by respective movement means 27 in a transverse direction, in this case orthogonal, to the nominal axis of feed A of the metal product P. The support rolls 24, 25, 26 allow to define a pre-established travel for the metal product P and tensioning loops around the second rolls 14.

The support rolls 24, 25, 26 allow the metal product P to move into contact with one of the second rolls 14 before it enters into contact with the first roll 11.

The first 24, the second 25 and the third support roll 26 can be disposed on the same side, with respect to the metal product P, as the first roll 13.

According to the forms of embodiment shown in FIGS. 1 and 3, the first support roll 24 is installed upstream of the first drawing unit 11, the second support roll 25 is interposed between the first 11 and the second 12 drawing unit and the third support roll 26 is located downstream of the second drawing unit 12.

The first 24, the second 25 and the third 26 support roll can have a diameter substantially equal to the diameter of the second rolls 14.

In possible forms of embodiment, downstream of the first drawing unit 11 and second drawing unit 12 a first group of rolls 28 and possibly a second group of rolls 29 can be provided.

The first group of rolls 28 and the second group of rolls 29 can be configured to straighten the metal product P previously bent between the first drawing unit 11 and the second drawing unit 12, in order to render it suitable for subsequent working provided downstream.

The first group of rolls 28 and the second group of rolls 29 can be mounted on their own support frame 30, even if it is not excluded that they can be mounted on the same support frame 18 as the first 11 and second 12 drawing unit.

In possible solutions, the support frame 30 and/or the support structure 18 can be selectively translatable with respect to the other in a direction transverse to the direction of feed of the metal product P.

According to possible forms of embodiment, the first group of rolls 28 comprises a first straightening roll 31 installed idle around its axis of rotation K.

In the case where the drawing unit 10 is configured to work several metal products P at the same time, the first group of rolls 28 can comprise a number of first straightening rolls 31 corresponding to the number of metal products P, each independently drivable.

According to possible implementations of the present invention, the first group of rolls 28 comprises a translation member 32 connected to the first straightening roll 31 and configured to move the latter in a direction transverse to its axis of rotation K and to the nominal axis of feed A of the metal products P. This solution allows to obtain a straightening action on the metal products P in a direction substantially parallel to that of the lying plane of the first straightening roll 31.

According to some forms of embodiment, the second group of rolls 29 comprises at least a second straightening roll 33 and a least a presser roll 34 cooperating, during use, with the second straightening roll 33 in order to exert a pressure and holding action on the metal product P passing through it.

In the case where the drawing unit 10 is configured to work several metal products P at the same time, the second group of rolls 29 can comprise a number of second straightening rolls 33 corresponding to the number of metal products P, each drivable independently from the other.

The second straightening roll 33 and the presser roll 34 have respective axes of rotation Q located orthogonal with respect to the lying plane π, and lying on a plane substantially orthogonal to the nominal axis of feed A of the metal product P.

In some forms of embodiment, the second group of rolls 29 can comprise two second straightening rolls 33 and two presser rolls 34, in order to hold two metal products P.

The second straightening rolls 33 are mounted coaxial with respect to each other and each has a circumferential groove to accommodate the metal products P in transit.

The presser rolls 34 are mounted coaxial with respect to each other and are provided with a contact surface with the metal products P.

The presser rolls 34 are mounted on a presser member 35 provided to move the presser rolls 34 against the second straightening rolls 33 and to exert a holding action on the metal products P.

In particular, the presser member 35 is selectively movable in a direction orthogonal to the axis of rotation of the presser rolls 34 and to the nominal axis of feed A.

According to some forms of embodiment, the presser member 35 can be chosen from a group comprising electric actuators, oil-dynamic actuators, jack screws, adjustment screws, electric motors, mechanical kinematisms, worm-screw kinematisms, racks or possible combinations thereof.

The at least one second straightening roll 33 is installed, in its turn, on a translator member 36, configured to move the at least one second straightening roll 33 in a direction parallel to its axis of rotation, that is, in a direction orthogonal to its lying plane.

In this way, the second straightening roll 33, in combination with the presser roll 34, imparts a deformation on the metal product P on a plane substantially orthogonal to the lying plane π.

According to possible forms of embodiment, and in the case where the second group of rolls 29 is provided with two second straightening rolls 33 and with two presser rolls 34, it can be provided that at least the two second straightening rolls 33 are movable independently to each other in the direction parallel to their axis of rotation.

According to some forms of embodiment of the invention, shown for example in FIGS. 1 and 3, the metal product P is introduced into the first drawing unit 11 at a determinate height and discharged from the second drawing unit 12 at a different height from that of its introduction. This condition allows to reduce the problems of rotation of the metal product P during the drawing of the metal product P.

It is clear that modifications and/or additions of parts may be made to the drawing unit 11 or 12 as described heretofore, without departing from the field and scope of the present invention.

For example, it can be provided that, in the case where the drawing unit 11 and 12 is configured to draw two or more metal products P, at least the first roll 13 and the second rolls 14 of each drawing unit 11 and 12 are each provided with a number of circumferential grooves corresponding to the number of metal products P which are drawn.

One of the metal products P to be made to advance is disposed in each circumferential groove.

The condition of the roll 13 or 14, provided in a single body of the circumferential grooves, allows to obtain an adequate action of feeding all the metal products P. A quicker feed of one of the metal products P is slowed down by the same roll 13, 14 which, in its turn, is held back by the friction that is generated between the latter and the metal product P which moves less quickly.

This condition allows to guarantee a uniform and predetermined feed of all the metal products P even in the case where they have slightly different sizes, for example due to possible variations in size of the work tolerances.

It is also clear that, although the present invention has been described with reference to some specific examples, a person of skill in the art shall certainly be able to achieve many other equivalent forms of drawing unit, having the characteristics as set forth in the claims and hence all coming within the field of protection defined thereby.

The invention claimed is:

1. A drawing unit for drawing at least one long metal product, configured to make said at least one long metal product advance along a nominal axis of feed and provided with at least a first motorized roll and with at least two second rolls operate at a periphery of said first motorized roll;

passage gaps defined by the first motorized roll and each of said at least two second rolls, wherein said at least two second rolls are located one on one side and the other on an other side of an axis orthogonal to the nominal axis of feed that passes through a center of rotation of the first motorized roll, wherein said at least two second rolls are associated with a movement member to move said each of said at least two second rolls in a parallel form with respect to each other and in a direction substantially orthogonal to said nominal axis of feed in order to adjust said passage gaps, said passage gaps configured along a straight line that joins the center of said first roll with a center of each of said at least two second rolls, an amplitude that is bigger in size than a nominal diameter of said metal product, wherein each of said at least two second rolls define a respective lying plane disposed substantially orthogonal to the nominal axis of feed of said metal product and on which an axis of rotation of each of the second roll lies, and wherein each of the at least two second rolls are disposed such that each respective lying plane intersect a bulk of said first motorized roll.

2. The drawing unit as in claim 1, wherein the first roll has a bigger diameter than a diameter of each of said at least two second rolls.

3. The drawing unit as in claim 1, wherein said each of at least two second rolls have a diameter comprised between 0.30 and 0.70 times the diameter of the first roll.

4. The drawing unit as in claim 1, wherein said drawing unit comprises three support rolls located peripherally to the first motorized roll, wherein a first of said three support rolls is located more upstream with respect to a second and third of said three support rolls, and at least one of the three support rolls is positioned outside the bulk defined by the first motorized roll, along the nominal axis of feed.

5. The drawing unit as in claim 1, wherein the amplitude that varies between 1.02 and 1.30 the nominal diameter of the metal product.

6. The drawing unit as in claim 1, further comprising a positioning member configured to move said at least two second rolls in a direction substantially parallel to said nominal axis of feed of said metal product.

7. A drawing apparatus, comprising:

two drawing units, located in succession and aligned along a nominal axis of feed of a metal product, wherein each of the two drawing units are according to the drawing unit of claim 1.

8. The drawing apparatus as in claim 7, further comprising support rolls located upstream and downstream of at least one of the first or second drawing units.

9. A drawing method for drawing at least one long metal product, comprising:

feeding said metal product through at least one drawing unit and along a nominal axis of feed;

operating said at least one drawing unit via at least a first motorized roll and with at least two second rolls at the periphery of said first motorized roll;

defining, via the first motorized roll and the at least two second rolls, respective passage gaps, wherein defining the respective passage gaps include arranging said at least two second rolls such that said at least two second rolls have one on one side and the other on the other side of the axis orthogonal to the nominal axis of feed that passes through the center of rotation of the first roll;

and disposing said at least two second rolls such that they have respective lying planes intersecting a bulk of a respective first motorized roll, wherein on each lying plane lies an axis of rotation of one of said second rolls, wherein each lying plane is disposed substantially orthogonal to the nominal axis of feed of the metal product, and said second rolls are moved and positioned in a parallel form with respect to each other and in a direction substantially orthogonal to said nominal axis of feed, so that each of said passage gaps, along the straight line that joins the center of said first motorized roll with the center of the respective second roll, has, during use, an amplitude that is bigger in size than the nominal diameter of said metal product.

10. The method as in claim 9, further comprising advancing the said metal product through the at least one drawing unit and through a second drawing unit located downstream of the at least one drawing unit, and aligning along said nominal axis of feed of said metal product.

* * * * *